United States Patent [19]

Sakamaki et al.

[11] Patent Number: 4,570,316

[45] Date of Patent: Feb. 18, 1986

[54] METHOD FOR MANUFACTURING A ROTOR FOR A ROTARY FLUID PUMP

[75] Inventors: Hiroshi Sakamaki, Tochigi; Susumu Sugishita; Yukio Horikoshi, both of Saitama, all of Japan

[73] Assignee: Nippon Piston Ring Co., Ltd., Japan

[21] Appl. No.: 691,866

[22] Filed: Jan. 16, 1985

Related U.S. Application Data

[62] Division of Ser. No. 610,664, May 16, 1984.

[30] Foreign Application Priority Data

May 20, 1983 [JP] Japan ..... 58-88928

[51] Int. Cl.[4] ..... B23P 15/00; B22D 19/14; F01C 21/00; F04C 15/00

[52] U.S. Cl. ..... 29/156.8 R; 29/156.4 R; 29/419 R; 29/419 G; 29/527.5; 29/527.6; 29/530; 29/DIG. 5; 29/DIG. 18; 164/97; 418/152; 418/179; 418/236

[58] Field of Search ..... 29/156.4 R, 156.8 R, 29/419 R, 419 G, 527.5, 527.6, 530, DIG. 5, DIG. 18; 164/97; 418/179, 236, 238, 270, 152

[56] References Cited

U.S. PATENT DOCUMENTS

| | | | |
|---|---|---|---|
| 2,455,303 | 11/1948 | Grate | 418/152 X |
| 3,282,222 | 11/1966 | Raufeisen et al. | 418/236 X |
| 4,198,195 | 4/1980 | Sakamaki et al. | 418/152 X |
| 4,216,682 | 8/1980 | Ban et al. | 164/97 X |
| 4,318,438 | 3/1982 | Ban et al. | 164/97 |
| 4,506,721 | 3/1985 | Ban et al. | 164/97 |

FOREIGN PATENT DOCUMENTS

| | | | |
|---|---|---|---|
| 78301 | 12/1970 | German Democratic Rep. | 418/152 |
| 16075 | 2/1979 | Japan | 418/152 |
| 151087 | 9/1982 | Japan | 418/179 |
| 278382 | 12/1927 | United Kingdom | 418/179 |

*Primary Examiner*—Howard N. Goldberg
*Assistant Examiner*—Ronald S. Wallace
*Attorney, Agent, or Firm*—Finnegan, Henderson, Farabow, Garrett & Dunner

[57] ABSTRACT

A rotor for a rotary compressor having a metal central portion integral with two opposite end portions that are fiber-reinforced metal matrix composites having a matrix metal common to the central portion. Such rotors may be made by pressing inorganic fibers to form the end portions of the rotor, arranging the end portions in an opposing relationship in a mold to form the central portion between the end portions. Molten metal is placed into the mold such that it infiltrates the porous end portions while forming the central portion. Solidification of the metal forms fiber-reinforced metal-matrix composite end portions integral with the central portion.

6 Claims, 8 Drawing Figures

METHOD FOR MANUFACTURING A ROTOR FOR A ROTARY FLUID PUMP

This is a division of application Ser. No. 610,664, filed May 16, 1984.

BACKGROUND OF THE INVENTION

The present invention relates to a rotor for a rotary fluid pump or compressor and to a method for its manufacture. Rotary compressors having a rotor assembly supported by a shaft must be carefully designed because of the relatively high local stresses where the shaft abuts the rotor and the rotation of such a rotor subjects this portion of the device to alternating loads that can induce fatigue fracture. While strengthening that portion of the device would alleviate such a problem, the fact that it is desirable from several standpoints to reduce the weight of the rotor makes overdesign of the rotor/shaft interface an undesirable solution to the problem.

SUMMARY OF THE INVENTION

It is the principal object of the invention to provide a rotor for a rotary compressor that has improved strength at the rotor/shaft interface while not being detrimentally heavy.

To achieve this and other objects of the invention, the rotary compressor of the present invention is comprised of a central portion formed of metal. Two opposite end portions that include the shaft portion are comprised of a fiber-reinforced metal matrix composite. Such a rotor is made by pressing a plurality of inorganic fibers into the form of each of the end portions of the rotor such that the pressed end portions are porous. The end portions are arranged in an opposing relationship in a mold disposed to form the central portion of the rotor between the end portions. Molten metal is placed into the mold under conditions where the molten metal infiltrates the porous end portions while also forming the central portion. The fiber-reinforced metal matrix composite end portions are formed integrally with the central portion comprised of the metal placed in the mold by solidifying the metal in the mold and within the porous end portions.

Other objects and advantages of the invention will be apparent from the description of the preferred embodiments or may be learned by practice of the invention.

BRIEF DESCRIPTION OF THE DRAWINGS

FIG. 2 is a side view in elevation of the end portion of a rotor.

FIG. 3 is a cross-sectional view taken along the line III—III of FIG. 2, showing the fiber-reinforced metal matrix composite end portion and shaft portions.

FIG. 4 is a cross-sectional front view showing the metal central portion.

FIG. 5 is a cross-sectional front view of end portions formed of compressed fibers arranged on both ends of a mold.

FIG. 6 is a cross-sectional view showing the condition where metal has infiltrated the porous end portions.

FIG. 7 is a perspective view of a cylinder formed by casting.

FIG. 8 is a cross-sectional front view of the cylinder of FIG. 7 having shaft portions forged on both ends.

DESCRIPTION OF THE PREFERRED EMBODIMENTS

The present invention is disclosed by means of preferred embodiments. The invention is a rotor for a rotary compressor or fluid pump having improved strength.

In accordance with the invention, the rotor for the rotary compressor is comprised of a central portion formed of metal. As here embodied, and most clearly depicted in FIG. 1, the rotor is generally cylindrical having a plurality of radially oriented vane grooves 4 disposed to contain vanes for a vane-type rotary compressor. The rotor may be formed of a non-ferrous metal such as aluminum, magnesium or their alloys or ferrous alloys.

Figure 8:
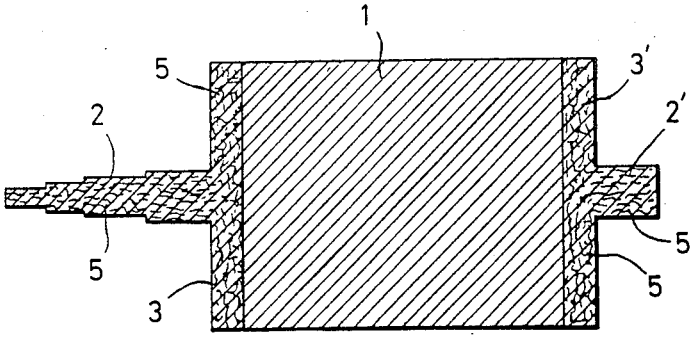

In accordance with the invention, the rotor further includes two opposite end portions including shaft means. As here embodied and most clearly depicted in FIGS. 1 and 8, the rotor 4 includes end portions 3 and 3' and shaft portions 2 and 2'. In accordance with the invention, the end portions and shaft portions are fiber-reinforced metal matrix composites. The metal of the central portion is the metal of the metal matrix composite.

Figure 1:
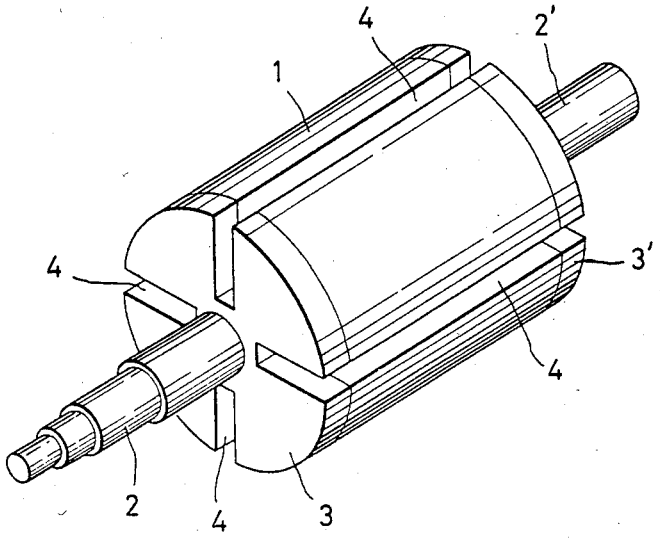
FIG. 1 is a perspective view of a rotor for a rotary compressor embodying the present invention.

As depicted in FIG. 1, the rotor end plates 3 and 3' having a shaft 2,2' on one side are joined to both sides of a rotor center portion 1 formed of a nonferrous material such as aluminum, aluminum alloy, magnesium alloy, etc. or an iron-based material. The shafts 2 and 2' and the end plates 3 and 3' are made of a fiber-reinforced metal matrix composite having the same matrix metal as the metal used for the rotor center portion 1. The rotor center portion 1 and the composite end plates 3 and 3' are formed integrally.

Figure 2:
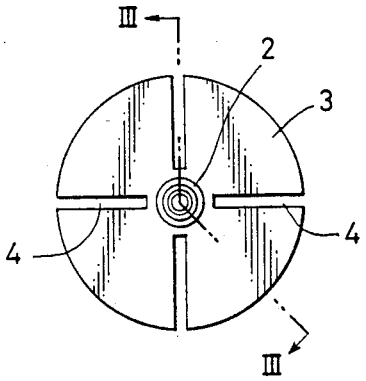
FIGS. 2 to 4 illustrate a method of manufacturing the rotor of this invention.
Figure 3:
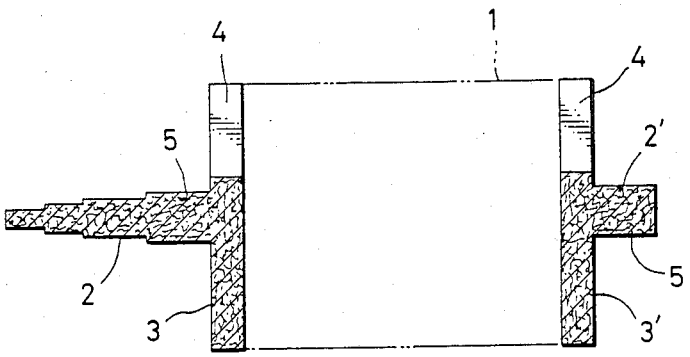
Figure 4:
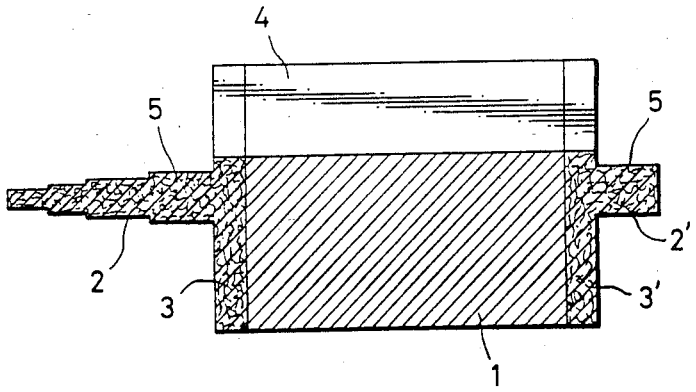

A method of manufacturing such a rotor will be described by referring to FIGS. 2 and 4. Discrete lengths of fiber 5 are pressed to form rotor end plates 3 and 3' having shaft portions 2 and 2' as shown in FIGS. 2 and 3. The porous portions have a maximum density of about 50%. With these end plates arranged on both ends of a mold as shown in FIG. 3, a molten nonferrous material such as aluminum, aluminum alloy, magnesium alloy, etc. or a molten iron-based material is poured to form a rotor center portion 1. At the same time the porous end plates 3 and 3' and shaft portions 2 and 2' are infiltrated with the molten metal to form a fiber-reinforced metal matrix composite material. Thus, by integrally forming the rotor center portion 1 and the end plates 3 and 3' having shafts 2 and 2' as shown in FIG. 4, the rotor shown in FIG. 1 may be obtained.

The vane grooves 4 in the rotor may be formed while casting the rotor or cut after casting. The fibers may be comprised of inorganic materials such as silicon carbide, carbon, glass, or other materials which are not dissolved or melted at the temperature of the molten metal to be infiltrated into the pressed fibers.

Figure 7:
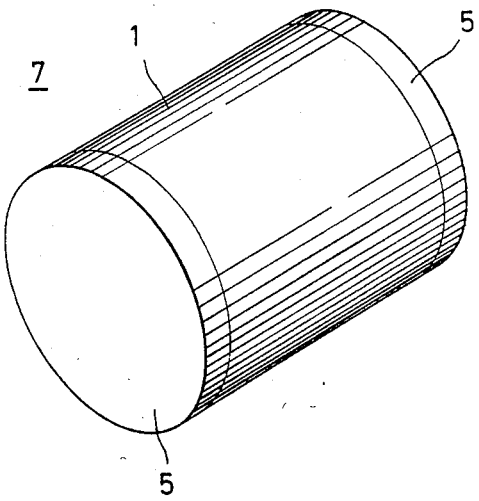
FIGS. 5 to 8 illustrate another method of manufacturing a rotor of this invention.
Figure 5:
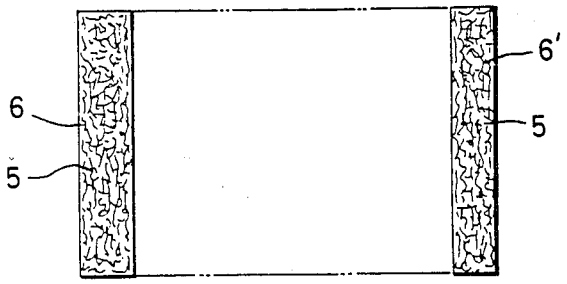
Figure 6:
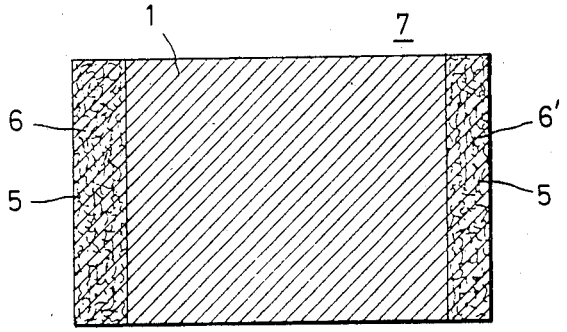

Another method of manufacturing a rotor will be described referring to FIGS. 5 to 7. Fibers 5 are pressed to such an extent that the maximum density becomes about 50% to form end plates 6 and 6'. With these end plates arranged on both sides of a mold as shown in FIG. 5, a molten nonferrous material such as aluminum, aluminum alloy, magnesium alloy, etc. or a molten iron-based material is poured to form the center portion of the rotor 1. At the same time, the porous end plates 6 and 6' are infiltrated with the molten metal to form a fiber-reinforced metal matrix composite material. Thus, a cylinder 7 having the rotor center portion 1 and the end plates 6 and 6' integrally joined can be obtained as shown in FIGS. 6 and 7.

Shaft portions 2 and 2' are formed by forging on both sides of the rotor center portion 1. By forming the shaft portions in such a manner as mentioned above, the fibers 5 are arranged parallel to the direction of the axis of the rotor resulting in an increase in the strength of the shaft portions.

In this invention, as mentioned above, the end plates on opposite ends of the rotor are infiltrated with the nonferrous or iron-based metal used in casting the rotor center portion to form fiber-reinforced metal matrix composite portions. Thus, the end and shaft portions of the rotor are reinforced with the composite end portions of the rotor having high friction resistance. The center portion of the rotor containing the vane grooves is formed of metal and as a result, the vanes function well. Furthermore, when the shafts are formed by forging, material flow in the direction of rotor axis arranges the metal grains and the reinforcing fibers in one direction, and the strength of the shaft portions is further increased.

The present invention has been disclosed in terms of preferred embodiments. The invention, however, is not confined thereto but is defined by the appended claims and their equivalents.

What is claimed is:

1. A method of making a rotor for a rotary compressor having a central portion and two opposite end portions, said end portions including shaft means, said method comprising the steps of:

(a) pressing a plurality of inorganic fibers into the form of each of the end portions of said rotor such that said pressed end portions are porous;

(b) arranging said end portions in an opposing relationship in a mold disposed to form said central portion between said end portions;

(c) placing molten metal into said mold under conditions whereby said molten metal infiltrates said porous end portions while also forming said central portion; and (d) forming fiber-reinforced metal matrix composite end portions integral with said central portion comprised of said metal by solidifying said metal in said mold and within said porous end portions.

2. The method of claim 1 including the step of forging said end portions to align said fibers after the step of forming.

3. The method of claim 2 wherein said forging step also forms said shaft means.

4. The method of claim 1 wherein said metal of said central portion and said metal of said metal matrix are selected from the group consisting of: iron, aluminum, magnesium and their alloys.

5. The method of claim 1 wherein said fibers are selected from the group consisting of silicon carbide, carbon and glass.

6. The method of claim 1 wherein said porous pressed end portions have a density less than about 50% by volume.

* * * * *